United States Patent [19]

Funkhouser

[11] 4,411,252

[45] Oct. 25, 1983

[54] WALL PROTECTOR AND HEAT CIRCULATOR

[76] Inventor: Berland M. Funkhouser, P.O. Box 2395, Winchester, Va. 22601

[21] Appl. No.: 327,188

[22] Filed: Dec. 3, 1981

[51] Int. Cl.[3] ..... F24C 15/36

[52] U.S. Cl. ..... 126/201; 126/80; 219/367; 98/36; 237/79

[58] Field of Search ..... 126/121, 120, 201, 202, 126/277, 110 B, 278, 279, 42, 66, 198, 67, 80, 77; 219/367; 237/52, 79, 55; 165/137; 98/36

[56] References Cited

U.S. PATENT DOCUMENTS

| | | | |
|---|---|---|---|
| 2,500,606 | 3/1950 | Dosmar | 98/36 |
| 2,775,187 | 12/1956 | McClurkin | 98/36 |
| 3,068,775 | 12/1962 | Zehnder | 98/36 |
| 3,089,403 | 5/1963 | Banko | 98/36 |
| 3,112,686 | 12/1963 | Peterson | 98/36 |
| 3,362,469 | 1/1968 | Berner et al. | 98/36 |
| 3,719,136 | 3/1973 | Criddle | 98/36 |
| 3,727,834 | 4/1973 | Weatherstron | 98/36 |
| 4,008,705 | 2/1977 | Robertson | 126/121 |
| 4,295,460 | 10/1981 | Wilson | 126/202 |
| 4,307,701 | 12/1981 | Balon et al. | 126/110 B |

FOREIGN PATENT DOCUMENTS

| | | | |
|---|---|---|---|
| 59825 | 3/1937 | Norway | 237/52 |

*Primary Examiner*—James C. Yeung

[57] ABSTRACT

The present invention comprises a linear element having openings in the upper surface, and which is closed at one end by a cap and at the other end by a fan unit which draws air from the room and projects it upwardly through the openings in the linear unit. The device is placed between the free-standing heating unit and the adjacent vertical surfaces to prevent the vertical surfaces from becoming too hot, as well as to prevent the subsequent drying out of wood framing behind the vertical surfaces, and also preventing or substantially reducing any chances of spontaneous combustion behind the vertical surfaces.

5 Claims, 5 Drawing Figures

WALL PROTECTOR AND HEAT CIRCULATOR

FIELD OF INVENTION

Present invention is in the general field of appliances to heat occupied spaces. More particularly, the present invention relates to a device which is external to free-standing heating unit, and which assists in the circulation of the heat from the unit and at the same time provides protection for any adjacent vertical surface.

BACKGROUND OF THE INVENTION

The cost of fuel for heating systems employing a furnace and ducts to convey the heated air throughout the occupied spaces has resulted in a return to free-standing heating units which can utilize wood or coal. Since these free-standing heatings units are made of steel or iron, they have become, by necessity, very hot during the burning of the fuel on the interior thereof. As a result, most manufacturers issue instructions regarding the use of a heat resistant material not only under the heating units but also on vertical surfaces adjacent to them. Very often the manufacturer specifies that the heating unit must be a certain distance from vertical surfaces if protective materials are not utilized. Building codes in most parts of the country wherein the free-standing units are used also contain regulations concerning the placement of the heating units.

While the free-standing heating unit provides heat by means of conversion from the heating unit itself, and to a certain extent from the ducts which lead from the stove to a chimney, many devices have been developed to increase the amount of heat which can be radiated into the room, particularly from the exhaust duct so as to recover more heat from the energy. These units generally are inserted into the duct and exhaust from the free-standing heat unit will either pass through several channels in the heat-enhancing unit, or draw air from the room to pass through other channels where it is heated by the temperature of the exhaust duct. Very often these radiation enhancers are also equipped with a small fan which increases the volume of air which can be passed through the radiation enhancing unit. Other devices include multi-fanned elements which may be clamped about the exhaust duct.

Generally speaking, these radiation enhancing units will provide increased radiation but do not provide any protection for the vertical surfaces adjacent to the free-standing heating unit. In many instances the use of heat resistant materials on the vertical surfaces is unattractive and not desired because of the particular decor of the room in which the heating unit is placed. This then necessitates moving the free-standing heating unit away from vertical surfaces out into the room where it is more noticeable and can only interfere with the generally normal arrangement of furniture and rugs and so forth in an occupied space.

SUMMARY OF THE PRESENT INVENTION

The present invention comprises a linear element having openings in the upper surface, and which is closed at one end by a cap and at the other end by a fan unit which draws air from the room and projects it upwardly through the openings in the linear unit. The device is placed between the free-standing heating unit and the adjacent vertical surfaces to prevent the vertical surfaces from becoming too hot, as well as to prevent the subsequent drying out of wood framing behind the vertical surfaces, and also preventing or substantially reducing any chances of spontaneous combustion behind the vertical surfaces.

BRIEF DESCRIPTION OF THE DRAWINGS

The present invention may be seen in the following drawing figures which are by way of illustration only and nonlimiting as to size and relative proportions and the like.

DETAILED DESCRIPTION OF THE INVENTION

Figure 1:
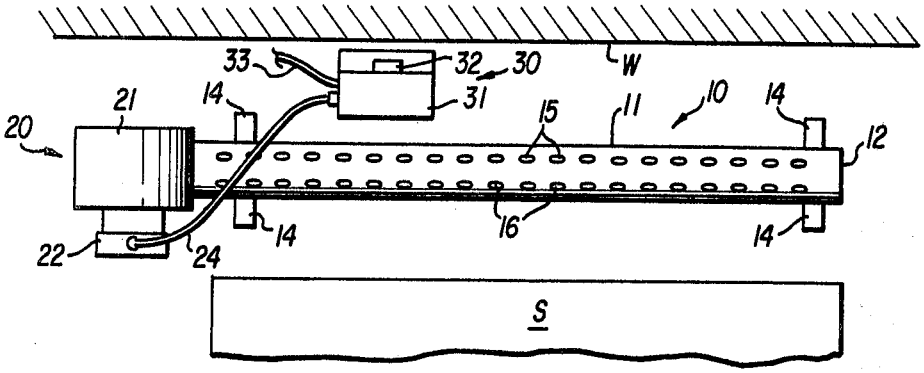
FIG. 1 is a top plan view of an embodiment of the present invention showing it installed.
Figure 2:
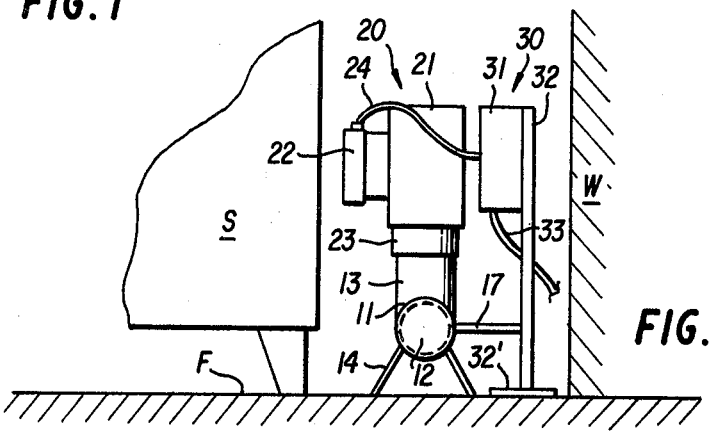
FIG. 2 is an elevation view of the right end of the embodiment shown in FIG. 1. The left elevation view will be substantially identical except for the reversal of the elements shown herein.

Referring now to FIGS. 1 and 2, the illustrated embodiment 10 of the present invention is shown in position between the back wall of the stove S and a vertical house wall W. In instances wherein the stove S is placed in a corner of a room where there would be a wall W on two sides of the stove S, embodiment shown in FIGS. 4 and 5 would be more suitable to accomplish the purposes of the present invention.

Figure 3:
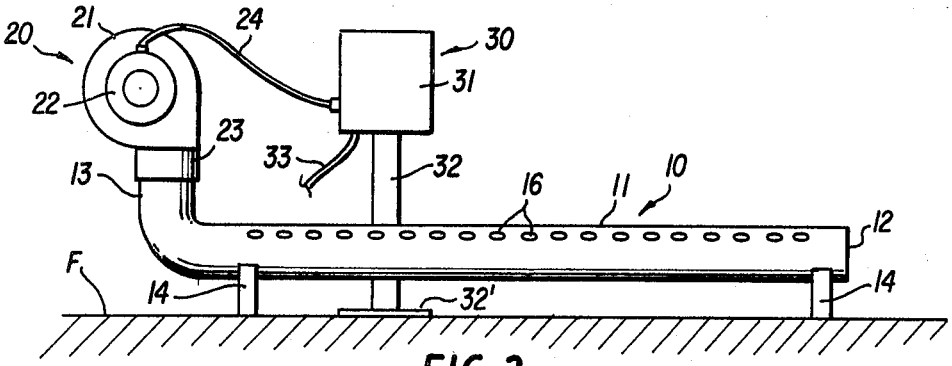
FIG. 3 is a front elevation view of one embodiment of the present invention.

With reference to FIGS. 1, 2, and 3, the illustrated embodiment 10 of the present invention is seen to be comprised of a tubular element 11 which acts as a duct for the discharge of air drawn into the tube 11 by the fan assembly 20 which is operated by a control unit 30. The tube 11 has a closed end 12 and an upturned opposing end 13 to which is attached the fan assembly 20. A plurality of holes, 15 and 16, extend along the upper surface of the tubular element 11. The holes are normally drilled at right angles to the surface of the tube and thus the ports or openings or holes on each side direct air from the interior of tube 11 to the back surface of the stove S in the case of hole 16 and on to the wall surface W through hole 15. The tube 11 is normally made from metal which is easily worked and yet which will endure the heat from the stove S without deformation. It is within the scope of the present invention to use materials other than metal for the tube providing they can withstand the heat from the stove at such times as the unit is not operating.

The fan assembly consists of a fan unit 21 driven by a motor unit 22. The lower portion of the fan unit 21 has a coupling sleeve 23 attached thereto which fits over the upturned end 13 of the tube 11. The fan assembly is activated by the control unit 30 and is connected thereto by conduit 24.

The control unit 30 is comprised of a temperature heat sensing unit 31 which is supported by a support leg 32 which may or may not have a foot element 32'. The control unit 30 is connected to the normal household current supply by conduit 33. The control unit 30 may be free-standing or it may be secured to the tube 12 by a bar 17 as shown in FIG. 2. It is within the scope of the present invention to attach the support leg 32 directly to the tube 11 also.

While the present invention may be placed directly upon the floor between the stove S and the vertical surface W, it has been found that the device operates more efficiently if the unit 10 is mounted on legs illustratively shown at 14 as being of flat bars. The legs may take many forms as will be recognized by those of ordinary skill in the art and may be attached to the tube by various well-known methods such as brazing, welding, by bands, adhesively, or by self-threading bolts.

Figure 4:
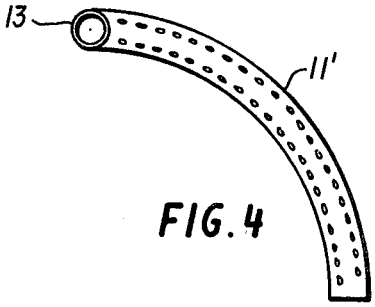
FIG. 4 is a top plan view of another shape which may be employed with the present invention.
Figure 5:
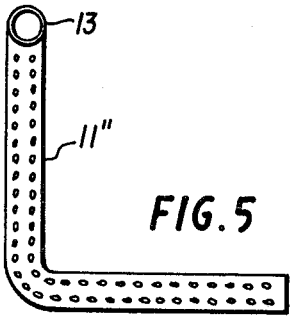
FIG. 5 is a top plan view of yet another configuration of the air circulating tube of the present invention.

The arcuate form of the current air circulating tube 11' shown in FIG. 4 will be appropriate for use when the stove has a curved outer surface. The curvature of the tube 11' may be varied to meet the requirements. The air circulating tube 11" shown in FIG. 5 would be very appropriate for use when the stove is placed in the corner of a room. The length of the tube 11, 11', or 11" may be varied in accordance with the width of the stove with which it is designed to operate.

Figure 6:
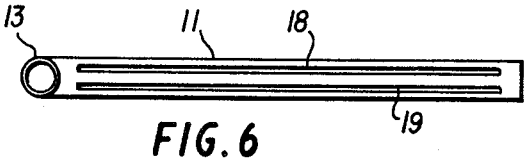
FIG. 6 is another embodiment of the air circulating tube of the present invention showing alternate means for discharge of air from the tube.

The holes 15 and 16 in tube 11 as seen in FIGS. 1 and 3 may be replaced by longitudinal slot openings 18 and 19 as seen in FIG. 6. Such slotted openings may also be employed with the tube embodiments 11' and 11".

In operation the air circulation device of the present invention is placed between the stove and the vertical surface. As the fire in the stove increases, the heat radiated therefrom, The heat sensor in the control device 30 has a predetermined temperature sensitivity, and when this temperature is attained, the control device 30 automatically actuates the motor on the fan assembly 20. The fan unit 21 draws in air from the floor level or lower portion of the room and forces it out through the holes 15 and 16 against the wall and back surface of the stove respectively. The air from the circulating unit is always cooler than the air heated by radiation from the stove and thus the vertical wall surface W is always at a much lower temperature than the stove. The back wall of the stove is cooled but not to the extent as to interfere with proper combustion of the heat-forming materials within the stove. The air circulation device of the present invention continues to operate as long as the temperature of the air radiated by the stove is above the preset level in the control unit. There are various types of control units available on the market, an example of one being that made by Suburban Manufacturing Company of Dayton, Tenn. Fan units of the squirrel cage type appear more suitable for this type of operation although any appropriately designed fan would be equally suitable. As mentioned previously, the device of the present invention appears to operate more efficiently if the device is on legs so that the device is at least as far above the floor level as the bottom of the firebox of the stove. Most stoves are lined with firebrick in the bottom and some have a partial lining along the walls unless those portions of the stove do not become as hot as the upper portions of the stove against which the air would normally be directed. It has been found that a tube of approximately two inches in diameter will provide adequate air circulation and is not obtrusive. Variations in the positioning of the fan assembly with reference to the tubular element may be made within the scope of the present invention as set forth in the following claims.

What is claimed is:

1. A device for placement between a free-standing heating unit and a vertical surface to prevent overheating of the vertical surface by the radiation of heat from the heating unit comprising an elongated tubular element mounted on support means and having one end closed, the other end being open; a fan assembly operatively connected with said other end of said tubular element to introduce a controlled flow of air into the interior said tube and discharged from said tube through at least two circumferentially spaced apart openings on the upper surface of said tube, one of said at least two openings being so positioned on said upper surface as to direct air passing therethrough from the interior of said tubular element in the direction of the vertical surface, the other side of said at least two openings being so positioned on said upper surface as to direct air passing therethrough from interior of said tubular element toward the adjacent heating unit surface; a temperature sensitive control assembly operatively associated with said fan assembly and activated by the temperature of the air heated by the heating unit; first electrical conduit means interconnecting said control assembly and said fan assembly and second electrical conduit means interconnecting said control assembly with a conventional source of electrical power.

2. The device according to claim 1 wherein said at least two circumferentially spaced apart openings comprises two parallel rows of a plurality of openings.

3. The device according to claim 2 wherein said spaced apart openings comprises a pair of linear slots in said upper surface.

4. The device according to claim 1 wherein said temperature sensitive control assembly is attached to said tubular element.

5. The device according to claim 1 wherein the form of said tubular element is selected from the group consisting of linear, arcuate, and L-shaped forms.

* * * * *